United States Patent [19]

Speich

[11] 4,120,221

[45] Oct. 17, 1978

[54] ARRANGEMENT FOR SEVERING WEBS

[75] Inventor: Francisco Speich, Gipf-Oberfrick, Switzerland

[73] Assignee: Jakob Müller, Forschungs-und Finanz AG, Frick, Switzerland

[21] Appl. No.: 843,782

[22] Filed: Oct. 19, 1977

[30] Foreign Application Priority Data

Oct. 20, 1976 [CH] Switzerland ..... 13281/76

[51] Int. Cl.[2] ..... B26D 7/10

[52] U.S. Cl. ..... 83/62.1; 83/171; 83/433

[58] Field of Search ..... 83/62.1, 62, 171, 16, 83/433, 651.1

[56] References Cited

U.S. PATENT DOCUMENTS 3,469,479 9/1969 Calemard ..... 83/171 X

*Primary Examiner*—J. M. Meister

*Attorney, Agent, or Firm*—Michael J. Striker

[57] ABSTRACT

An arrangement for severing webs, particularly fabrics, of thermally severable materials includes a severing tool which is mounted on a support for displacement between an extended position and a retracted position thereof, being urged towards its extended position. The severing tool has a severing portion which is heated and which contacts and severs the web during the movement of the latter longitudinally of itself in a path past the support for the severing tool. A heat-conductive member is in heat-transmitting contact with the severing tool at the severing portion thereof in the extended position of the severing tool, the heat-transmitting relationship being interrupted when the resistance of the web to the severing action of the severing portion achieves such a value that the severing tool is displaced from its extended position toward its retracted position. The severing portion may be either a reduced cross-section portion of a U-shaped severing member mounted on the severing tool, or a replenishable section of a wire, either one of which is heated by an electric resistance accompanying the passage of electric current therethrough. The position of the abutment member relative to the severing portion of the severing tool may be adjustable, and so may the force with which the severing tool is urged toward its extended position. When the severing tool reaches its retracted position, either the entire arrangement may be shut off or the amount of electric current delivered to the severing portion may be stepped up.

12 Claims, 2 Drawing Figures

ARRANGEMENT FOR SEVERING WEBS

BACKGROUND OF THE INVENTION

The present invention relates to a severing arrangement in general, and more particularly to a severing arrangement for webs, particularly fabrics, of thermally severable materials.

It has already been recognized that some fabrics or other webs, particularly such containing a large proportion of thermoplastic material, if not made entirely from such thermoplastic material, can be severed by resorting to a heated severing tool which penetrates into the thermally severable material of the fabric or other web and thus subdivides the same into two or more pieces. Based on this recognition, it has already been proposed to mount the severing tool which is intended to sever the fabric or web for displacement between an extended and a retracted position, the severing tool being urged towards its extended position and being displaced towards its retracted position in dependence on the resistance which the material of the fabric or other web offers to the penetration of the heated severing portion of the severing tool into such material during the severing action of the severing portion.

An arrangement of the above-mentioned type has already been disclosed, for instance, in the German Patent DT-PS 2,315,333. As already mentioned before, the severing tool of this arrangement which has the heatable severing portion is urged towards its extended position in such a manner that, when the web is to be cut in the longitudinal direction thereof during the longitudinal advancement of the web, the plane along which the severing tool is displaced as it moves from the retracted position to the extended position thereof is parallel to the longitudinal axis of the web and the direction of such displacement is opposite to the direction of advancement of the web. In this arrangement, when the resistance of the web to the penetration of the severing portion of the severing tool exceeds a predetermined value, the severing tool is displaced in the advancing direction of the web towards its retracted position, which results in the energization of a heating circuit. As a result of such an energization, the heatable severing portion of the severing tool is raised in temperature, so that the severing action of the severing portion is improved and the tool element, which is urged towards its extended position will be displaced toward the latter contrary to the advancement direction of the web.

Experience with this arrangement has shown that it is possessed of certain disadvantages. So, for instance, it is a pronounced drawback of this arrangement that the heating circuit is constantly being switched on and off which, on the one hand, results in a considerable consumption of electric power. On the other hand, and even more importantly, the constant switching on and off results in a very irregular appearance of the edge of the web at which the severed regions of the web are separated from one another. Furthermore, should the severing action of the severing tool be insufficient despite the heating of the severing portion of the severing tool, then the advancing web would move past the severing tool without being severed thereby which would result either in incomplete or non-existent severance of the web or, worse still, in a damage to the severing arrangement.

SUMMARY OF THE INVENTION

Accordingly, it is a general object of the present invention to avoid the disadvantages of the prior art.

More particularly, it is an object of the present invention to construct a severing arrangement for severing webs, such as fabrics, which is not possessed of the above-described disadvantages of the prior-art arrangements of this type.

It is a further object of the present invention to so design the above-mentioned severing arrangement as to be continuously heatable but still capable of operating at different temperatures.

A concomitant object of the present invention is to devise a severing arrangement which is simple in construction, inexpensive to manufacture, and reliable in operation nevertheless.

In pursuance of these objects and others which will become apparent hereafter, one feature of the present invention resides, briefly stated, in an arrangement for severing webs, particularly fabrics of thermally severable materials, which arrangement comprises a support; means for severing a respective web, including a severing tool having a severing portion, and means for heating at least said severing portion of said severing tool; means for so mounting said severing tool on said support that said severing portion contacts and severs the web during relative movement between the latter and said support and also for displacement of said severing tool relative to said support between an extended position and a retracted position in dependence on the resistance offered by the web to the severing action of said severing portion, including means for urging said severing tool toward said extended position thereof; and means for controlling the severing action of said severing portion by regulating the temperature of the latter, including a heat-conductive abutment member which is in a heat-transmitting contact with said severing tool at said severing portion thereof in said extended position, and out of such contact in said retracted position, of said severing tool. Advantageously, the web is elongated and moves longitudinally thereof in a path past the support which is stationary. Then, the mounting means so mounts the severing tool on the support that the severing portion extends across the path and faces longitudinally of the web opposite to the direction of movement of the latter, in and between the extended and retracted positions of said severing tool.

As a result of the fact that the severing tool which includes a severing portion that is continuously heated, abuts against the heat-conductive abutment member, a part of the heat content of the severing portion of the severing tool is transmitted to the abutment member, as s result of which the severing portion of the severing tool is maintained at a first temperature which will be so adjusted that an optimum severing action of the severing portion on the advancing web is achieved. On the other hand, if the web contains irregularities of such a type that the above-mentioned first temperature is insufficient for enabling the severing portion to cut through such irregularities, the attendant increased resistance of the web to the penetration of the severing portion of the severing tool thereinto will result in a situation where the advancing web will lift the severing tool from the abutment member, thus interrupting the heat-transmitting relationship of the severing tool with the abutment member, whereby the temperature of the severing portion of the severing tool will rise to a level at which the severing portion of the severing tool will be able to penetrate through the above-mentioned irregularities of the web, thus severing the web even in the region of such irregularities. An important advantage of the severing arrangement of the present invention is that, despite its possession of the above-enumerated advantageous properties, it is of an extremely simple construction, inasmuch as it does not require any complicated controlling and switching arrangements for regulating the electric current which heats the severing portion by resistance heating, despite the fact that two different temperatures are achieved for the severing portion of the severing tool. The above-mentioned first temperature of the severing portion can be maintained at a relatively low level, as a result of which there is obtained a high quality of the severed edges of the separated regions of the web.

According to a further advantageous aspect of the present invention the mounting means includes means for adjusting the force with which the urging means urges the severing tool toward the extended position thereof. In this manner, it is possible to select the magnitude of the resistance of the web for the penetration of the severing portion of the severing tool thereinto from which up the severing tool having the heated severing portion is lifted from the abutment member, that is, from which up the temperature of the severing portion of the severing tool is raised from the above-mentioned first temperature to the higher second temperature.

It is particularly advantageous when the controlling means further includes means for supporting the abutment member on the support for adjustment of the position thereof relative to the severing portion of the severing tool. As a result of this adjustability of the position of the abutment member, the first temperature which has been mentioned above and which prevails at the region of contact of the severing portion with the web can be adjusted with a high degree of accuracy. The smaller is the distance of the abutment member from the region of contact of the severing portion, the lower is the temperature prevailing at such a contact region inasmuch as heat is withdrawn from the severing portion of the severing tool into the abutment member. When the distance between the abutment member and the contact region of the severing portion is larger, the influence of the heat-withdrawing abutment member on the temperature prevailing at the contact region of the severing portion of the severing tool is diminished so that the corresponding first temperature prevailing at the contact region of the severing portion is correspondingly higher In this manner the effective temperature prevailing at the contact region of the severing portion can be adjusted without resorting to electrical components. This expedient is especially advantageous when using a plurality of severing tools having several severing portions, inasmuch as it renders it possible to electrically interconnect the individual heatable severing portions in series, while the temperature of the individual severing portions at their contact regions is adjusted by means of the abutment members. A series arrangement of the severing portions renders it possible to use smaller cross-sections of the conductors for the heating current.

An especially advantageous embodiment of the present invention is obtained when the arrangement includes means for interrupting the operation of the arrangement when the resistance of the web to the severing action of the severing portion exceeds a predetermined magnitude, such interrupting means including a shut-off switch operated by the severing tool in the retracted position thereof. Under these circumstances, even when the web includes an above-average irregularity therein, which cannot be cut through even when the severing tool is lifted from the abutment member and the temperature of the severing portion thereof thus rises to the second temperature, the web or the severing arrangement are not damaged in that the severing tool is merely displaced into its retracted position in which it actuates the shut-off switch, thus stopping the entire severing arrangement. As an alternative thereto, the severing arrangement could comprise means for augmenting the heating action of the heating means when the resistance of the web to the severing action of the severing portion exceeds a predetermined magnitude, such augmenting means including means for increasing the magnitude of the electric current supplied to the severing portion at least when the severing tool is in the retracted position thereof, such increasing means including an energizing switch operated by the severing tool. In this manner, as a result of the increase in the electric current passing through the heatable severing portion of the severing tool, such severing portion achieves a third temperature exceeding the above-mentioned second temperature, the third temperature being sufficient for enabling the severing portion of the severing tool to penetrate through the above-mentioned above-average irregularity of the web.

Advantageously, the severing tool includes a blade-shaped heatable severing member having the above-mentioned severing portion. This renders it possible to effortlessly move the severing member. Such a severing member can be manufactured in an economically advantageous manner by, for instance, stamping.

An especially advantageous embodiment of the present invention is obtained when the above-mentioned blade-shaped separating member is of a U-shaped configuration and is made of an electrically resistive conductor material, the severing portion being a reduced cross-section portion of the above-mentioned U-shaped severing member.

In a further advantageous embodiment of the present invention, the severing tool includes an electrically resistive conductive wire which constitutes the severing portion and through which electric current is passed to heat the conductor wire. Advantageously, a supply of the wire is mounted on the severing tool in such a manner that the wire can be so displaced longitudinally thereof that successive sections of the wire are serially displaced into a severing position in which the respective section replaces the previously deteriorated wire section and constitutes the above-mentioned severing portion of the severing tool. In this manner, when a respective section of the wire deteriorates, such as by the deposition of dirt or the material of the web thereon, it can be easily replaced by the next succeeding section, without need for disassembling and reassembling any components of the severing arrangement.

It is particularly advantageous in the context of the present invention when the above-mentioned supporting means for the wire includes a payout reel and a takeup reel for the wire, and means for guiding the wire from the payout reel to the takeup reel, including a tubular guide accommodating the wire and extending along a substantially U-shaped course. When so constructed, the supporting means for the wire is especially simple.

Special advantages result when the heatable severing portion of the severing tool is only of a short length. This results in a relatively low consumption of electric power such as, for instance, 2 watt per severing portion so that when a plurality of the severing portions is arranged in a single circuit, the overall energy consumption is extremely low as compared to the heretofore known severing arrangements. In addition thereto as a further result of the short length of the severing portion, no overheating is encountered at the contact region of the severing portion with the web when the severing arrangement is shut off, due to the fact that the relatively short severing portion of the severing tool has a relatively low heat-storage capacity so that the heat contents of the severing portion of the severing tool dissipates very quickly. On the other hand, the temperature of the severing portion can be very quickly brought to the desired level upon the restoration of the operation of the severing arrangement, exactly because of the low heat-storage capacity of the relatively short severing portion of the severing tool, so that the incidence of traces of the commencement of operation of the severing arrangement on the severed edges of the separated regions of the web is kept to a minimum, if at all present.

The heating arrangement, for instance a heating roller, can be arranged downstream of the above-discussed severing arrangement, which serves to relieve tensions in the separated regions of the web after being acted upon by the severing arrangement.

The above-discussed severing arrangement is especially suited for severing fabrics and it can be advantageously arranged immediately downstream of a machine for manufacturing such fabrics.

The novel features which are considered as characteristic for the invention are set forth in particular in the appended claims. The invention itself, however, both as to its construction and its method of operation, together with the additional objects and advantages thereof, will be best understood from the following description of specific embodiments when read in connection with the accompanying drawings.

DETAILED DISCUSSION OF THE PREFERRED EMBODIMENTS

Figure 1:
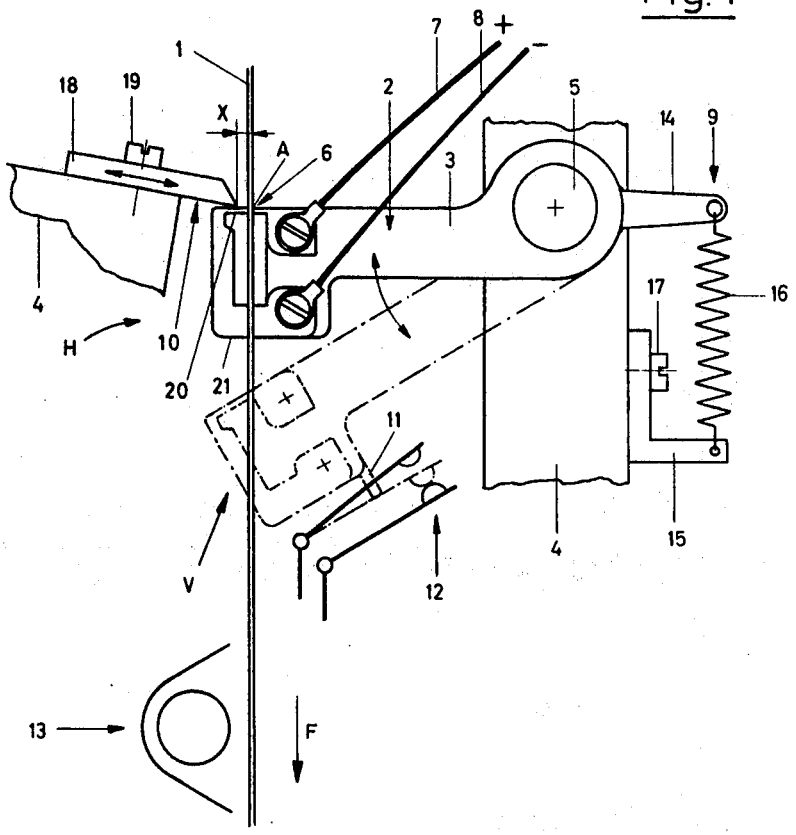
FIG. 1 is a side elevational view of a severing arrangement according to a currently preferred aspect of the present invention.

Referring now to the drawing in detail, and first to FIG. 1 thereof, it may be seen therein that a severing arrangement of the present invention is to be used, as illustrated, for the continuous severing of an advancing web 1. The severing arrangement can be arranged immediately downstream of a fabric manufacturing machine, such as a weaving machine, to be used for severing the fabric or web 1 emerging from such a machine. The web 1 consists predominantly or exclusively of a thermoplastic material.

The severing arrangement includes a severing tool 2 which includes a lever 3 which is pivotally mounted on a support 4 by a pivot 5. The lever 3 has a free end portion which is remote from the pivot 5, and a heatable severing member 5 is mounted on the lever 3 of the severing tool 2. The severing member 6 consists of an electrically resistive conductor material and electric current is being delivered thereto via leads 7 and 8. The severing tool 2 is movable in the longitudinal direction of the web 1, and is urged by a biasing arrangement 9 opposite to the advancement direction F of the web 1 in such a manner that the heatable severing member 6 abuts, in an extended position H of the severing tool 2 shown in solid lines in FIG. 1, against a heat-conductive abutment member 10 which, in turn, is mounted on the support 4. The severing tool 2 is displaceable from the above-mentioned extended position H into a retracted position V illustrated in dash-dash-dotted lines in FIG. 1, in dependence on the resistance offered by the advancing web 1 to the penetration of the severing member 6 thereinto. In the retracted position V of the tool element 2 an extension 11 displaces a limit switch 12, which is open in its initial position, into its closed position. The limit switch 12 controls a circuit which is conventional and not illustrated in the drawing, which, for instance, shuts off the entire arrangement or supplies additional electric current to the heatable severing member 6, when actuated in the retracted position V of the severing tool 2. An auxiliary heating arrangement 13 is arranged downstream of the severing arrangement as considered in the direction F of advancement of the web 1, the auxiliary heating arrangement 13 serving to relieve tensions in the regions of the web 1 which have been previously severed by the severing arrangement of the present invention.

In the example of the embodiment of the present invention illustrated in FIG. 1, the arrangement 9 which urges the severing tool 2 towards its extended position H includes a projection 14 rigid with the lever 3, and a holder 15 mounted on the support 4, the projection 14 and the holder 15 being interconnected by a tension spring 16. The holder 15 is provided with a non-illustrated elongated slot through which a screw 17 extends, the screw 17 connecting the holder 15 to the support 4. When the screw 17 is loosened, the holder 15 may be adjusted in its position, thus adjusting the distance between the projection 14 and the holder 15, and consequently, the force with which the tension spring 16 urges the severing tool 2 towards its extended position H.

The heat-conductive abutment 10 which serves the purpose of withdrawing heat from the severing tool 2, includes a bracket 18 which is provided with a non-illustrated elongated slot in which a screw 19 is received, the screw 19 connecting the bracket 18 to the support 4. When the screw 19 is loosened, the bracket 18 can be displaced relative to the support 4 and, in this manner, the distance X between the abutment member 10 and a region A of contact of the severing member 6 with the web 1 can be varied.

The severing member 6 includes a reduced cross-section severing portion 20 and is a part of a blade-shaped component 21 of a U-shaped configuration and made of an electrically resistive conductor material. As a result of the reduced cross-section of the severing portion 20 of the component 21, only such severing portion 20 will be heated by the passage of the electric current supplied by the lines 7 and 8 therethrough, to such an extent as to be capable of severing the advancing web 1 in its longitudinal direction. The reduced cross-section severing portion 20, or the heatable severing member 6, is relatively short so that the severing portion 20 will quickly cool upon the interruption of the delivery of the electric current thereto, on the one hand, and is quickly brought to its operating temperature upon the establishment of the passage of the electric current therethrough.

Having so discussed the construction of the severing arrangement illustrated in FIG. 1, the function thereof will now be briefly discussed.

After electric current is delivered to the severing component 21 through the lines 7 and 8, the advancement of the web 1 in the advancing direction F is commenced. Thereupon, the heat-conductive abutment member 10 is so adjusted in its distance X from the region A of contact of the severing member 6 with the web 1, that the severing member 6 abuts against abutment member 10 during the normal operation of the severing arrangement. Under these circumstances the severing portion 20 achieves a first temperature which is sufficient for severing the web 1, provided that no substantial irregularities are present therein. On the other hand, when the web 1 includes significant irregularities, then these irregularities offer an increased resistance to the penetration of the severing portion 20 into the web 1, thus displacing the severing tool 2 from its extended position H towards its retracted position V thus dissociating the separating member 6 from the abutment member 10. As a result of this, the heat-withdrawal from the severing member 6 into the abutment member 10 is interrupted so that the severing portion 20 achieves a second, higher temperature which, as a rule, is sufficient for cutting through the irregularities of the web 1. However, should the irregularities be of such a character that this second temperature of the severing portion 20 is not sufficient to enable the severing portion 20 to cut therethrough, then the severing tool 2 is displaced all the way into its retracted position V in which it actuates the limit switch 12. The limit switch, as already mentioned above, can be used for augmenting the amount of electric current delivered to the severing member 6, so that the severing portion 20 achieves an even higher third temperature, or the limit switch 12 can deenergize the entire severing arrangement and stop the advancement of the web 1 so that the disturbing irregularity can be manually removed.

Figure 2:
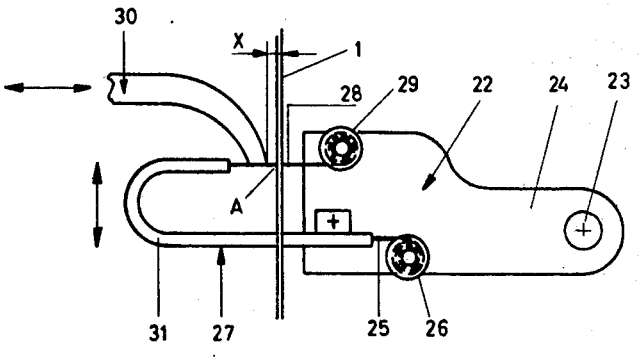
FIG. 2 is a side elevational of a modified detail of the severing arrangement of FIG. 1.

A modification of the severing arrangement of FIG. 1 is illustrated in FIG. 2 in which a severing tool 22 again includes a lever 24 which is mounted on a pivot 23 for pivoting thereabout. The severing tool 22 includes an electric resistance wire 25 which is guided from a payout reel 26 through a guide 27 to a pickup reel 29, the wire 25 having an exposed section 28 which constitutes the above-discussed severing portion. The severing section 28 of the resistance wire 25 is contacted by a heat-conductive and heat-withdrawing abutment 30 the distance X of which from the region A of contact of the section 28 of the wire 25 with the web 1 is adjustable in a manner which has not been illustrated but which may, for instance, be the same as that described above in connection with FIG. 1.

The guide 27 includes a tubular member 31 which extends along a substantially U-shaped course. The severing tool 22 of FIG. 2 can be used instead of the severing tool 2 of the severing arrangement of FIG. 1. An advantage of the severing tool 22 resides in the fact that a soiled or otherwise deteriorated section 28 can be transported away from the severing location and replaced thereat by a succeeding severing portion 28 withdrawn from the payout reel 26, the deteriorated sections 28 of the wire 25 being stored on the takeup reel 29. In this manner, it is not necessary to replace the wire 25 unless and until all of the sections 28 of the wire 25 which can be brought into the operative positions thereof have been exhausted.

According to a further aspect of the present invention which has not been illustrated in the drawing, it is also possible to connect the pivotable severing tool 2 or 22 with a regulating resistance which will control the amount of the electric current delivered to the heating portion 20 or 28 in proportion to the extent to which the severing tool has been displaced from its extended position H towards its retracted position V.

It will be understood that each of the elements described above, or two or more together, may also find a useful application in other types of constructions differing from the types described above.

While the invention has been illustrated and described as embodied in a severing arrangement for longitudinally severing advancing webs, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that from the standpoint of prior art, fairly constitute essential characteristics of the generic or specific aspects of this invention.

What is claimed as new and desired to be protected by Letters Patent is set forth in the appended claims.

1. An arrangement for severing webs, particularly fabrics, of thermally severable materials, comprising a support; means for severing a respective web, including a severing tool having a severing portion, and means for heating at least said severing portion of said severing tool; means for so mounting said severing tool on said support that said severing portion contacts and severs the web during relative movement between the latter and said support and also for displacement of said severing tool relative to said support between an extended position and a retracted position in dependence on the resistance offered by the web to the severing action of said severing portion, including means for urging said severing tool toward said extended position thereof; and means for controlling the severing action of said severing portion by regulating the temperature of the latter, including a heat-conductive abutment member which is in a heat-transmitting contact with said severing tool at said severing portion thereof in said extended position, and out of such contact in said retracted position, of said severing tool.

2. An arrangement as defined in claim 1, wherein the web is elongated and moves longitudinally thereof in a path past said support which is stationary; and wherein said mounting means so mounts said severing tool on said support that said severing portion extends across said path and faces longitudinally of the web opposite to the direction of movement of the latter, in and between said extended and retracted positions of said severing tool.

3. An arrangement as defined in claim 1, wherein said mounting means further includes means for adjusting the force with which said urging means urges said severing tool toward said extended position thereof.

4. An arrangement as defined in claim 1, wherein said controlling means further includes means for supporting said abutment member on said support for adjustment of the position thereof relative to said severing portion of said severing tool.

5. An arrangement as defined in claim 1; and further comprising means for interrupting the operation of the arrangement when the resistance of the web to the severing action of said severing portion exceeds a predetermined magnitude, including a shut-off switch operated by said severing tool in said retracted position thereof.

6. An arrangement as defined in claim 1; and further comprising means for autmenting the heating action of said heating means when the resistance of the web to the severing action of said severing portion exceeds a predetermined magnitude.

7. An arrangement as defined in claim 6, wherein at least said severing portion of said severing tool is of an electrically resistive conductor material; wherein said heating means includes means for passing electric current through said severing portion; and wherein said augmenting means includes means for increasing the magnitude of the electric current supplied by said passing means to said severing portion at least when said severing tool is in said retracted position thereof, including an energizing switch operated by said severing tool.

8. An arrangement as defined in claim 1, wherein said severing tool includes a blade-shaped severing member of a substantially U-shaped configuration and being of an electrically resistive conductor material; wherein said severing portion is a reduced cross-section portion of said severing member; and wherein said heating means includes means for passing electric current through said severing portion of said severing member.

9. An arrangement as defined in claim 1, wherein said severing tool includes an electrically resistive conductor wire constituting said severing portion; and wherein said heating means includes means for passing electric current through said wire.

10. An arrangement as defined in claim 9, further comprising a supply of said wire and means for so supporting said supply on said severing tool for displacement of said wire longitudinally thereof that successive sections of said wire constitute said severing portion upon deterioration of the preceding sections.

11. An arrangement as defined in claim 10, wherein said supporting means includes a playout reel and a takeup reel for said wire, and means for guiding said wire from said payout reel to said takeup reel, including a tubular guide accommodating said wire and extending along a substantially U-shaped course.

12. An arrangement as defined in claim 1, wherein said severing portion of said severing tool has only a short length.

* * * * *